United States Patent [19]

Gönner

[11] Patent Number: 4,503,892

[45] Date of Patent: Mar. 12, 1985

[54] DEVICE FOR PRODUCING FLAT WOOD ARTICLES

[75] Inventor: Siegmar Gönner, Oberkirch, Fed. Rep. of Germany

[73] Assignee: Gebrüder Linck Maschinenfabrik und Eisengiesserei "Gatterlinck", Oberkirch, Fed. Rep. of Germany

[21] Appl. No.: 471,638

[22] Filed: Mar. 3, 1983

[30] Foreign Application Priority Data

Mar. 3, 1982 [DE] Fed. Rep. of Germany ..... 3207548

[51] Int. Cl.[3] ..... B27L 9/00

[52] U.S. Cl. ..... 144/3 P; 144/120; 144/159; 144/184

[58] Field of Search ..... 144/120, 175, 184, 255, 144/155, 162 R, 185, 186, 2 R, 114 R, 3 P, 159

[56] References Cited

U.S. PATENT DOCUMENTS

| | | | |
|---|---|---|---|
| 689,277 | 12/1901 | Beck | 144/184 |
| 1,503,784 | 8/1924 | Dumont | 144/184 |
| 1,783,187 | 12/1930 | Elliott | 144/255 |
| 2,336,535 | 12/1943 | Elliott et al. | 144/255 |

FOREIGN PATENT DOCUMENTS

| | | | |
|---|---|---|---|
| 204181 | 11/1908 | Fed. Rep. of Germany | 144/255 |
| 251490 | 1/1979 | Fed. Rep. of Germany . | |
| 439689 | 7/1979 | Switzerland . | |
| 2025314A | 1/1980 | United Kingdom . | |

*Primary Examiner*—W. D. Bray

*Attorney, Agent, or Firm*—Michael J. Striker

[57] ABSTRACT

In a device for producing flat boards separated from a square timber trunk by blades in a non-cutting manner a straightening device is provided for each blade. Each straightening device includes an adjustable bending roll mounted at one side of the board separated from the trunk in a curved state and a rotatable flexible element which forms at the side of the board opposite to the bending roll a continuous flexible pressure surface upon rotation of the flexible element.

8 Claims, 2 Drawing Figures

7
9
5
10
12
30
8
2
11
13
22
21
20
19
A
20
21
2
11
13
22
8
12
7
9
5
10

13
11
10
12
17
18

DEVICE FOR PRODUCING FLAT WOOD ARTICLES

BACKGROUND OF THE INVENTION

The present invention relates to devices for producing flat wood articles, such as flat boards from square timber.

Conventional devices for manufacturing flat boards comprise a plurality of oscillating blades disposed at both sides of the square timber trunk which is advanced in the longitudinal direction. Oscillating blades separate the boards from the remaining portion of the trunk in non-cutting manner.

One of the known devices disclosed in the German Patent DE-PS No. 25 14901 includes a number of oscillating blades positioned at both sides of the longitudinally movable square timber in the staggered manner, which blades operate to separate wood sections from the trunk in non-cutting mode. Wood sections produced by the non-cutting process are usually curved as they are separated from the trunk and this curvature remains on the produced boards, which presents an obstacle for their utilization.

SUMMARY OF THE INVENTION

It is an object of the present invention to provide an improved device for producing flat boards.

It is another object of the invention to provide a device in which the curvature of the boards caused by the non-cutting process during their manufacturing is totally eliminated.

These and other objects of the invention are attained by a device for producing flat wood articles, such as boards, comprising cutting blades positioned at two opposite sides of a square timber trunk advanced in the direction of elongation thereof, said cutting blades separating flat boards from said trunk upon the advancement of the trunk in said direction whereby the boards separated from the trunk are curved; and a plurality of board straightening means each positioned immediately behind each blade as seen in said direction, each straightening means including an adjustable bending roll positioned against one side of the curved board, and a driven rotatable counter pressure means at another side of the curved board, disposed substantially against said bending roll, said counter pressure means forming a continuous flexible pressure surface when said counter means is driven; said pressure surface abutting against said another side of the board such that a pulling action is imparted to the board during its separation from the trunk and the board being processed is straightened.

Due to the fact that the board separated from the trunk runs immediately and continuously between the bending roll and the driven flexible pressure surface and since the bending roll is adjustable for adjusting a bending action on the board, the device of the invention ensures that all the boards withdrawn from the straightening device are straightened. Due to the pulling force exerted on the board by the straightening device while the board is separated from the trunk the separated process itself is affected favorably. The danger that the spacing clearance during the separating process is uncontrollable, particularly at the end of the separating process is totally avoided. Without the pulling action the spacing clearance can occur shortly before the end of the square timber trunk, substantially in the direction of wood fibers of the timber, and the process can run in undesired course.

Inasmuch as the wood article being produced in the device of the invention remains in constant contact with the flexible pressure surface at the side of the article opposite to the bending roll during the straightening process, a potential damage to the article in the separating and straightening steps of the process is totally prevented from occurring. Practically unlimited speeds of driving of the counter pressure means make possible the full adjustment of the device to the relatively high working speeds applied to the device in non-cutting separating process, so that the advantage of high working speeds of the manufacturing process can be fully utilized in the invention.

The curvature of the boards resulted from the separating process depends on many factors such as the thickness of the square timber, the kind of wood being processed, the moisture of the wood being treated and conditions of work. Due to these factors wood boards with various curvatures are produced. The invention renders it possible that characteristic quantities of the straightening process can be adjusted to each above mentioned condition so that independently from the above noted factors only straight boards are produced in the device according to the invention.

The straightening device for wood, which employs a rotary flexible open-link chain as a counter pressure device for the bending roll is disclosed in U.S. Pat. No. 1,783,187. This device serves, however, to curve the wood pieces which were originally straight. This device is employed in immediate conjunction with the device for manufacturing wood articles separated from the trunk without producing chips, which articles should have been produced in straight shape. The disclosed device can not be employed in the board separating apparatus of the kind utilized in the present invention.

The counter pressure means of the invention may include two belt rolls spaced from each other and a belt running over said belt rolls, said belt forming said flexible pressure surface. One of the belt rolls may be pivotally adjusted against said another side of the board.

The device according to the invention may include a hydraulic cylinder and a pivotable arm connected thereto, said arm being connected to said one belt roll to adjust its position against the board.

According to a further feature of the invention the counter pressure means may include a hollow tire having a rolling surface which forms said flexible pressure surface.

According to still another modification the counter pressure means may include a roller of elastic material.

The device may further include means for adjusting the position of the bending roll against said one side of the board.

The adjusting means may include a hydraulic cylinder and a pivotable arm interconnected between said cylinder and said bending roll.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
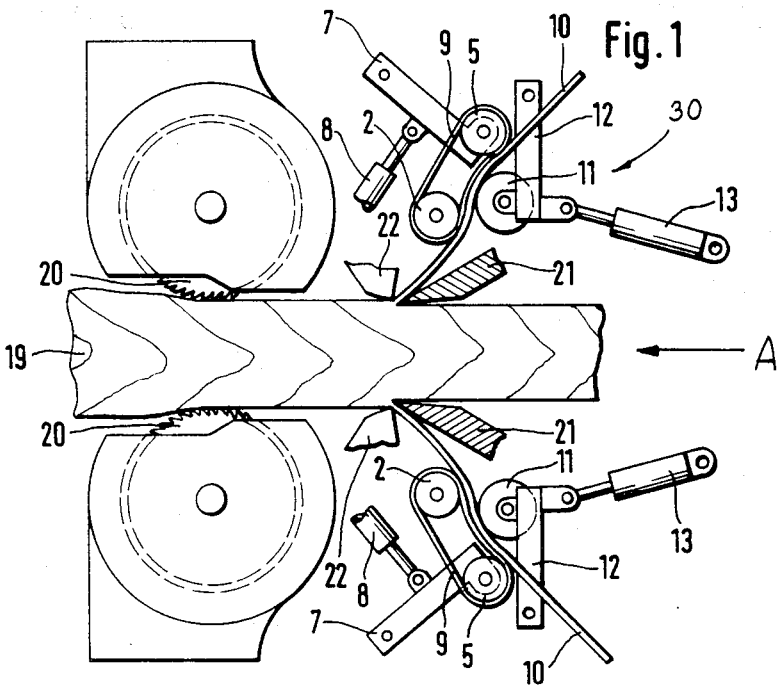
FIG. 1 is a schematic side view of the device for producing flat wood articles with an apparatus for separating flat wood from a trunk and a straightening device according to the invention.

Referring first to FIG. 1 it will be seen that a device for manufacturing flat wood articles, such as boards, includes a device for separating a flat board denoted as 10 from a trunk 19 of square timber and a straightening device generally designated as 30.

Flat wood articles are produced by separating the side boards 10 from both sides of the trunk 19 in the usual non-cutting manner.

Wood trunk 19 is fed in the direction of elongation thereof shown by arrow A by any suitable transport means (not shown). At both opposite sides of the trunk are disposed milling cutters 20 of the mill tool, which cutters cut off the outer layer of the trunk to produce a smooth outer surface thereon. Right after the mill cutters 20 in the direction of advancement of the trunk are positioned, at both opposite sides of the trunk, blades 21 which operate to separate boards 10 from the remaining portion of the trunk in non-cutting manner. An oscillatory motion is imparted to blades 21. Each blade 21 has in the vicinity of the cutting edge thereof a counter pressure tool 22 which presses blade 21 against the outer side of the trunk to facilitate non-cutting separating process and at the same time to precisely guide the trunk when it passes the blades; the latter is important particularly when square timber or the like articles are used.

The board 10 separated from the trunk 19 without chips has, as clearly seen from FIG. 1, a curvature directed in the outward direction. Therefore board 10 is fed to the straightening device 30. Board 10 is straightened in the straightening device so that the totally straightened board leaves the device 30.

Each blade 21 is provided with a respective straightening device. In the embodiment herein shown two analogous straightening devices are positioned at both opposite sides of the trunk 19. Only one straightening device will be described for the sake of simplicity. The straightening device includes two rollers 2 and 5 supported in a machine frame not shown herein and spaced from each other and carrying a belt 9.

Belt driven roller 2 is rotatably mounted in the machine frame and is driven, preferably by a motor mounted in the machine frame and having controlled number of revolutions. The second belt roller 5 is pivotally supported on the end of a swingable arm 7 also supported in the machine frame. Arm 7 is pivoted by a piston rod of a hydraulic cylinder 8 mounted in the machine frame. The endless belt 9 runs over rollers 2 and 5. Belt 9 may be, in the preferred embodiment, formed as a rubber belt with a cloth filler.

The upper strand of belt 9 forms a continuous, stable and flexible pressure surface for the curved board 10. The straightening device further includes a bending roll 11 positioned against the surface of the board and opposite to the pressure surface of the belt 9 and pressed against that surface. The curved board 10 is fed between belt 9 and bending roll 11. The latter is pivotally supported on the end of a swingable arm 12 mounted in the machine frame. Arm 12 is pressed against bending roll 11 by means of a hydraulic cylinder 13 also supported in the machine frame.

Hydraulic cylinder 8 operates to impart a given tension to belt 9 so that a pressing force acting to press the belt 9 against bending roll 11 and thus exerted on the board 12 fed therebetween, can be adjusted. Hydraulic cylinder 13 serves to adjust pressure of the bending roll against the board 10 such that an angle of grip between the bending roll 11 and board 10 can be varied. These two above described adjustments result in the bending action which is so controlled that the original curvature of the board 10 is totally eliminated and the straightened board is withdrawn from the straightening device. Due to the provision of the adjustable bending roll at one side of the board and a continuous flexible counter pressure surface of the belt 9 of the opposite side of the board a pulling action is imparted to the board so that the latter is straightened as it leaves the clearance between the bending roller and the belt 9.

Figure 2:
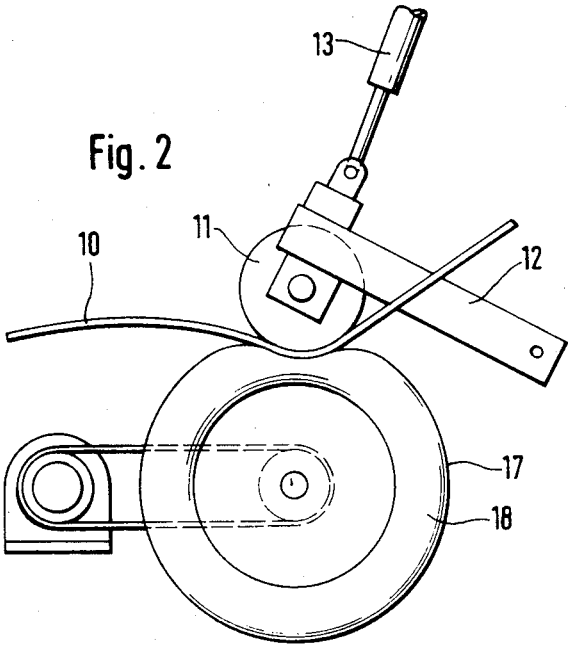
FIG. 2 is a schematic view of a straightening device in accordance with another embodiment of the invention.

FIG. 2 illustrates a modified embodiment of the invention. The basic distinction between this modified device for straightening the board and that of FIG. 1 is that the continuous flexible counter pressure surface for the board 10 is formed not by means of the belt but by a rolling surface or tread 17 of a hollow hoop or tire 18 or by elastic roll, which is rotated by a motor in the mode similar to that described for belt 9.

In this embodiment bending roll 11 is adjusted against board 10 by means of hydraulic cylinder 13 in the manner described herein above. The pressure ratio between the bending roll 11 and rolling surface 17 of tire 18 and the angle of grip between the bending roll 11 and board 10 can be adjusted independently from each other; for this purpose the inner pressure of the hollow tire 18 can be changed.

The drive of the belt roller 2 or the hollow tire 18 is performed so that board 10 is moved from the point of separation under pulling action which favorably affects the separating process.

If the device for non-cutting separation of the boards or similar flat wood articles has a number of staggered blades 21 at each side of the trunk it is preferable that each blade is provided with the respective straightening device in the manner depicted in FIG. 1.

It will be understood that each of the elements described above, or two or more together, may also find a useful application in other types of devices for manufacturing flat wood articles differing from the types described above.

While the invention has been illustrated and described as embodied in a device for producing flat wood articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for producing flat wood articles, such as boards, comprising oscillating cutting blades positioned at two opposite sides of a square timber trunk advanced in the direction of elongation thereof, said cutting blades separating flat boards from said trunk upon the advancement of the trunk in said direction whereby the boards separated from the trunk are curved and no chips are produced while said boards are separated from said trunk, each of the separated curved boards having one side facing the trunk and another side opposite to said one side; and a plurality of board straightening means each positioned immediately behind each blade as seen in said direction, each straightening means including an adjustable bending roll positioned against said one side of the curved board, and a driven rotatable counter pressure means positioned at another side of the curved board and disposed substantially against said bending roll, said counter pressure means forming a continuous flexible pressure surface when said counter means is driven, said pressure surface abutting against said another side of the board such that a pulling action is imparted to each board during its separation from the trunk and the board being processed becomes straightened.

2. The device as defined in claim 1, wherein said counter pressure means includes two belt rolls spaced from each other and a belt running over said belt rolls, said belt forming said flexible pressure surface.

3. The device as defined in claim 2, wherein one of said belt rolls is pivotally adjusted against said another side of the board.

4. The device as defined in claim 3, including a hydraulic cylinder and a pivotable arm connected thereto, said arm being connected to said one belt roll to adjust its position against the board.

5. The device as defined in claim 1, wherein said counter pressure means includes a hollow tire having a rolling surface which forms said flexible pressure surface.

6. The device as defined in claim 1, wherein said counter pressure means includes a roller of elastic material.

7. The device as defined in claim 1, further including means for adjusting the position of said bending roll against said one side of the board.

8. The device as defined in claim 7, wherein said adjusting means includes a hydraulic cylinder and a pivotable arm interconnected between said cylinder and said bending roll.

* * * * *